US009415596B2

(12) United States Patent
Togashi

(10) Patent No.: US 9,415,596 B2
(45) Date of Patent: Aug. 16, 2016

(54) LIQUID EJECTING HEAD AND LIQUID EJECTING APPARATUS

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/876,299

(22) Filed: Oct. 6, 2015

(65) Prior Publication Data

US 2016/0096367 A1 Apr. 7, 2016

(30) Foreign Application Priority Data

Oct. 6, 2014 (JP) ..... 2014-205912

(51) Int. Cl.
*B41J 2/15* (2006.01)
*B41J 2/14* (2006.01)

(52) U.S. Cl.
CPC ..... *B41J 2/1433* (2013.01)

(58) Field of Classification Search
CPC ..... B41J 2/14072; B41J 2/04541; B41J 2002/14491; B41J 2/14024; B41J 2/1408; B41J 2/1433; B41J 2/01
See application file for complete search history.

(56) References Cited

U.S. PATENT DOCUMENTS 8,191,996 B2 * 6/2012 Omata ..... B41J 2/04541 347/56
8,556,389 B2 * 10/2013 Golda ..... B41J 2/335 347/58
8,777,377 B2 * 7/2014 Nagata ..... B41J 2/14072 347/50
2005/0001868 A1 1/2005 Matsuba et al.
2005/0001877 A1 1/2005 Chikanawa et al.
2005/0001881 A1 1/2005 Nakashima et al.

FOREIGN PATENT DOCUMENTS

JP 2004-322606 A 11/2004
JP 2006-256049 A 9/2006
JP 2013-159088 A 8/2013

* cited by examiner

*Primary Examiner* — Lamson Nguyen
(74) *Attorney, Agent, or Firm* — Workman Nydegger

(57) ABSTRACT

A liquid ejecting head includes a set-up surface that faces a support body in a negative Z direction and that is fixed to the support body, an ejection surface that faces in a positive Z direction and in which are located nozzles that eject ink, and a first support surface and a second support surface that face in the positive Z direction and are located on the negative Z direction side of the ejection surface, and, when viewed in the Z direction, are separated from each other with the ejection surface interposed therebetween in the Y direction.

18 Claims, 5 Drawing Sheets

LIQUID EJECTING HEAD AND LIQUID EJECTING APPARATUS

CROSS-REFERENCE TO RELATED APPLICATIONS

The entire disclosure of Japanese Patent Application No: 2014-205912, filed Oct. 6, 2014 is expressly incorporated by reference herein in its entirety.

BACKGROUND

1. Technical Field

The present invention relates to a technique for ejecting liquid such as ink.

2. Related Art

To date, structures that support liquid ejecting heads that eject liquid such as ink from nozzles have been proposed. For example, in JP-A-2006-256049, a structure in which a plurality of linearly arranged liquid ejecting heads are fixed to a long substrate is disclosed. The long substrate is located above the liquid ejecting heads, and the upper surface of each of the liquid ejecting heads facing the long substrate is fixed to the long substrate with screws. That is, the plurality of liquid ejecting heads are fixed to the long substrate in a suspended state.

Concerning a stage before a liquid ejecting head is installed in a printing apparatus (for example, an inspection stage, a transportation stage, or the like), when provisionally storing an ink ejection head for, for example, safe keeping, in a state where a surface in which a plurality of nozzles have been formed (referred to as "ejection surface" below) is directed downward, there is a possibility of the ejection surface being damaged by coming into contact with a mounting surface. Therefore, it is necessary to store the liquid ejecting head in a state where the ejection surface does not come into contact with other components such as the mounting surface. However, in the structure of JP-A-2006-256049 in which the upper surface of each liquid ejecting head is fixed to a long substrate, it is difficult to hold the liquid ejecting head in a state in which the ejection surface is separated from other components in a stage prior to installation of the liquid ejecting heads.

SUMMARY

An advantage of some aspects of the invention is that damage to the ejection surface of a liquid ejecting head is prevented.

First Aspect

A liquid ejecting head according to a suitable aspect of the invention (first aspect) includes a first surface that faces a support body on a first side of a first direction and is fixed to the support body, a second surface that faces a second side opposite the first side in the first direction, and on which are located nozzles that eject liquid, a third surface and a fourth surface that face the second side in the first direction and are located on the first side of the first direction with respect to the second surface, and when viewed in the first direction, are separated from each other with the second surface interposed therebetween in the second direction that is perpendicular to the first direction. In the first aspect of the invention, because the third surface and the fourth surface that face toward the second side of the first direction are included, for example, by making the third surface and the fourth surface be in contact with a mounting surface of a certain holder, it is possible to hold a liquid ejecting head in a state where the second surface is separated from other components. Therefore, it is possible to prevent damage to the second surface (ejection surface) of the liquid ejecting head. Moreover, because the first surface, which faces the support body on the opposite side to the second surface on which the nozzles are located, is fixed to the support body, it is possible to reduce the size of the liquid ejecting head viewed in the first direction. Further, because the third surface and the fourth surface are separated from each other with the second surface interposed therebetween in a second direction, it is possible to reduce the nozzle spacing between individual liquid ejecting heads when a plurality of liquid ejecting heads are arranged along the third direction that is perpendicular to the first direction and the second direction.

Second Aspect

According to a suitable example of the first aspect of the invention (second aspect), it is preferable that the liquid ejecting head further include a plurality of members including a member having the third surface and the fourth surface and members stacked on the first side of the first direction with respect to the member having the third surface and the fourth surface, in which at least two members among the plurality of members, when viewed in the first direction, are fixed to each other at a location that overlaps the third surface or the fourth surface. In the second aspect of the invention, it is preferable that, when viewed from the second direction, individual members be fixed to each other at a location that overlaps the third surface or the fourth surface. Therefore, for example, it is possible to fix each of the members in a stable state in which the third surface and the fourth surface are in contact with a mounting surface of a holder Third Aspect According to a suitable example of the second aspect of the invention (third aspect), it is preferable that the liquid ejecting head further include a circuit substrate arranged between the plurality of members, in which the plurality of members, when viewed from the first direction, are fixed at the periphery of the circuit substrate. In the third aspect, the plurality of members are fixed to each other at the periphery of the circuit substrate. Therefore, in the case where individual members are pressed together and fixed to each other, it is possible to reduce the stress on the circuit substrate caused by the pressing force of the individual members. Moreover, because the circuit substrate is arranged between the plurality of members that are located on the first side of the first direction with respect to the third surface and the fourth surface, there is an advantage in that it is possible to increase the size of the circuit substrate compared with a structure in which the circuit substrate is arranged between the second surface and the third surface or the fourth surface.

Fourth Aspect

According to a suitable example of the third aspect of the invention (fourth aspect), it is preferable that the liquid ejecting head further include a plurality of drive elements that eject the liquid from the nozzles, in which the plurality of drive elements are electrically connected to the circuit substrate via wiring that passes through a through hole formed in at least one member among the plurality of members. In the fourth aspect, the plurality of drive elements are electrically connected to the circuit substrate via wiring that passes through a through hole formed in at least one member among the plurality of members. Therefore, for example, compared with a structure that connects each drive element to the circuit substrate through wiring on the periphery of the plurality of members, there is an advantage in that it is easy to secure the third surface and the fourth surface.

Fifth Aspect

According to a suitable example of any of the second to fourth aspects of the invention (fifth aspect), it is preferable that the plurality of members include a holding member that holds a filter through which the liquid passes, and the plurality of members are fixed to each other in a detachable state. In the fifth aspect, because the filter is fixed by a holding member located on the first side of the first direction with respect to the third surface and the fourth surface, there is an advantage in that it is possible to increase the size of the filter compared with a structure in which the filter is arranged between the second surface and the third surface or the fourth surface. Moreover, because it is possible to detach the plurality of members from each other, there is an advantage in that it is easy to perform maintenance such as cleaning of the filter.

Sixth Aspect

According to a suitable example of any one of the first to fifth aspects of the invention (sixth aspect), it is preferable that the liquid ejecting head further include a first flow path member that has the third surface and the fourth surface, and a second flow path member that is fixed to the first flow path member and that forms a flow path for the liquid between the second flow path member and the first flow path member. In the sixth aspect, there is an advantage in that, by fixing the first flow path member and the second flow path member to each other, a liquid flow path is formed and the third surface and the fourth surface are formed.

Seventh Aspect

According to a suitable example of the sixth aspect of the invention (seventh aspect), it is preferable that the first flow path member and the second flow path member include a side surface that faces in a third direction that is perpendicular to the first direction and the second direction. In the above aspect, the liquid that has reached the side of the liquid ejecting head is guided by and held between the first flow path member and the second flow path member by capillary force at the boundary of the side surface of the first flow path member and the side surface of the second flow path member. Therefore, there is an advantage in that the likelihood of liquid that has reached the side of the liquid ejecting head adhering to the liquid ejecting target object is reduced.

Eighth Aspect

According to a suitable example of any one of the first to seventh aspects of the invention (eighth aspect), it is preferable that the liquid ejecting head include an adjustment member that is located between the first surface and the support body, in which a fixing position of the adjustment member and the first surface, when viewed in the first direction, is closer to the third surface or the fourth surface than a fixing position of the adjustment member and the support body is. In the eighth aspect, because the fixing position of the first surface and the adjustment member is closer to the third surface or the fourth surface than the fixing position of the adjustment member and the support body is, for example, it is possible to fix the adjustment member to the first surface at a stable posture in which the third surface and the fourth surface are in contact with a mounting surface of the holder.

Ninth Aspect

According to a suitable example of any one of the first to eighth aspects of the invention (ninth aspect), it is preferable that a member having the first surface, a member having the third surface and a member having the fourth surface be formed of the same material. In the ninth aspect, because the member having the first surface, the member having the third surface and the member having the fourth surface are formed of the same material, there is an advantage in that the occurrence of thermal stress caused by differences in linear expansion coefficient between the individual members forming the liquid ejecting head can be reduced.

Tenth Aspect

A liquid ejecting apparatus according to a suitable aspect (tenth aspect) of the invention includes the liquid ejecting head according to any one of the first to ninth aspects. For example, the liquid ejecting apparatus according to a suitable example of the tenth aspect include a plurality of liquid ejecting heads arranged in a third direction that is perpendicular to the first direction and the second direction. A preferable example of the liquid ejecting apparatus is a printing apparatus that ejects ink onto a medium such as printing paper; however, the usage of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
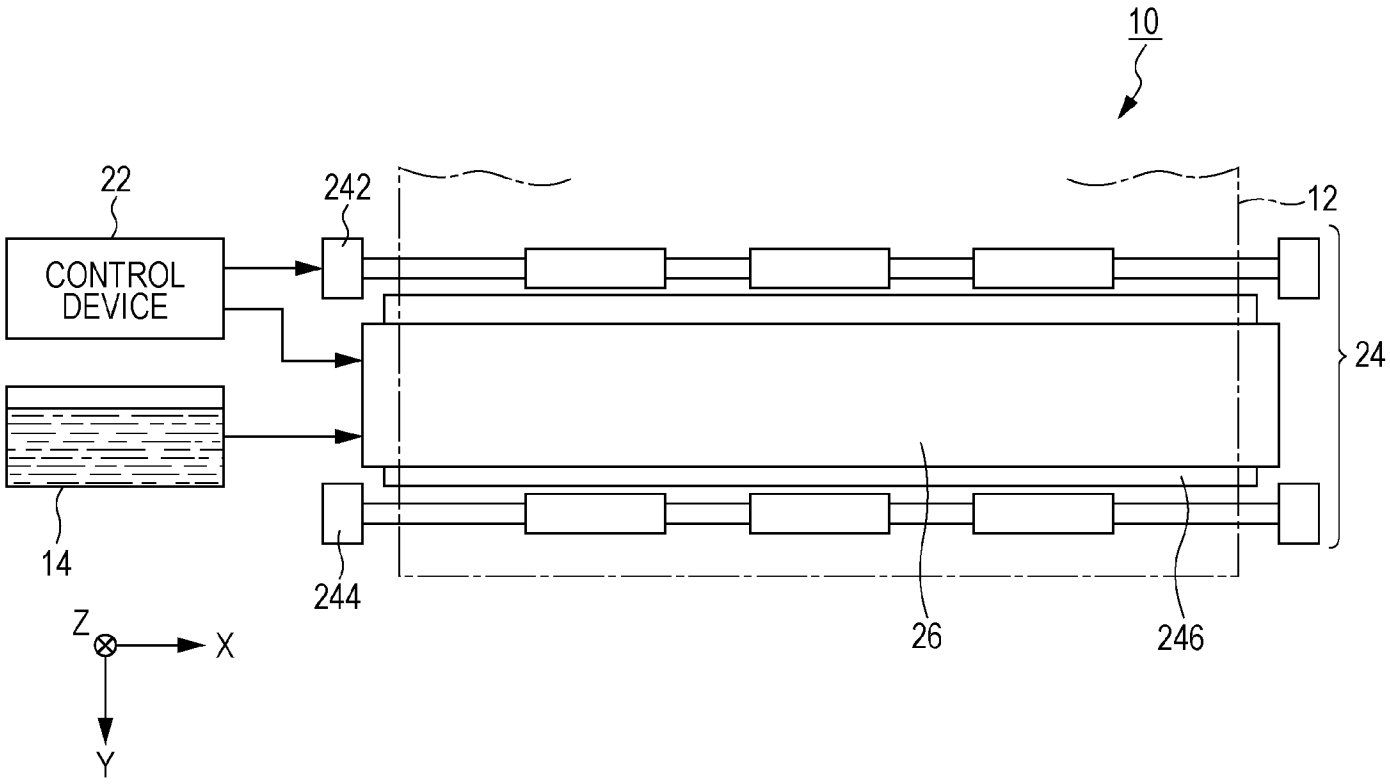
FIG. 1 is a structural diagram of a printing apparatus according to an embodiment of the invention

FIG. 1 is a partial structural diagram of a printing apparatus 10 of an ink jet system according to a preferred embodiment of the invention. The printing apparatus 10 of this embodiment is a liquid ejecting apparatus that ejects ink, which is an example of a liquid, onto a medium (ejection target object) 12 such as printing paper, and, as illustrated in FIG. 1, includes a control device 22, a transport mechanism 24, and a liquid ejecting module 26. The control device 22 controls each component of the printing apparatus 10. The transport mechanism 24 transports the medium 12 in the Y direction under the control of the control device 22. A liquid container (cartridge) 14 that stores ink of a plurality of colors is installed in the printing apparatus 10. In the liquid container 14, for example, inks of four colors in total of cyan (C), magenta (M), yellow (Y), and black (Bk) are stored.

Figure 2:
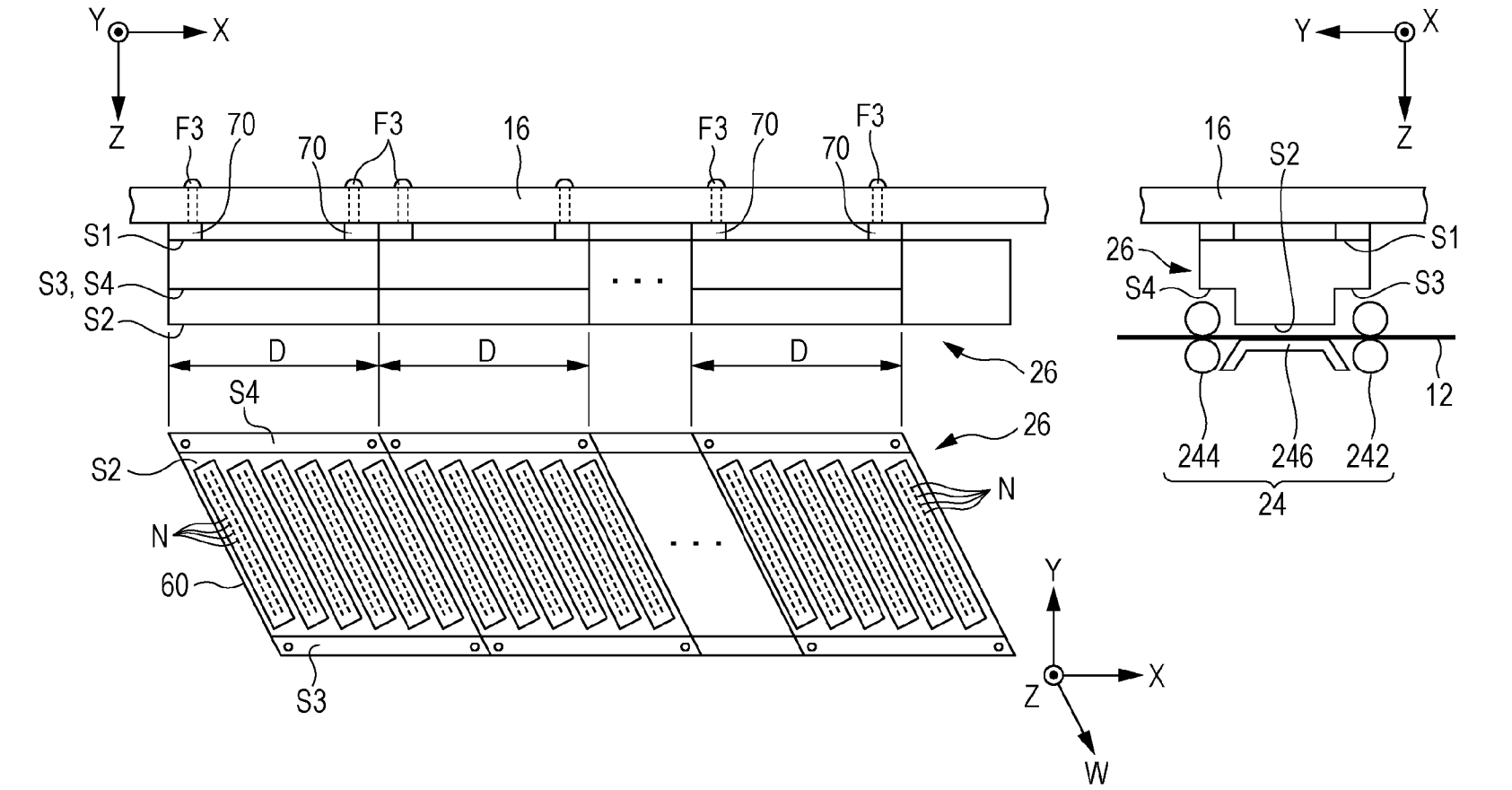
FIG. 2 is a structural diagram of a liquid ejecting module.

FIG. 2 is a structural diagram of the liquid ejecting module 26. In the side view of FIG. 2, the transport mechanism 24 is additionally illustrated for convenience. As illustrated in FIGS. 1 and 2, the transport mechanism 24 includes, for example, a transport roller 242, a discharge roller 244, and a medium holding portion 246. The transport roller 242 is arranged on the negative Y direction side of the discharge roller 244 (on the upstream side of the transport direction of the medium 12) and transports the medium 12 to the discharge roller 244 side. The discharge roller 244 transports the medium 12, which has been supplied from the transport roller 242, in the positive Y direction. The medium holding portion 246 is a tabular structure (platen) that holds the medium 12 that is transported by the transport roller 242 and the discharge roller 244. Moreover, as long as the medium 12 can be transported, the structure of the transport mechanism 24 is not limited to the example described above.

The liquid ejecting module 26 is a line head that is long in the X direction that is perpendicular to the Y direction, and that ejects ink supplied from the liquid container 14 onto the medium 12 under the control of the control device 22. As illustrated in FIG. 2, the liquid ejecting module 26 includes a plurality of liquid ejecting heads D that are arranged along the X direction. The plurality of liquid ejecting heads D are supported by a support body 16. The support body 16 is a structure (frame) that forms a housing of the liquid ejecting module 26. Each of the liquid ejecting heads D includes a set-up surface S1 which is to be fixed to the support body 16. Each of the liquid ejecting heads D is supported by the support body 16 in such a manner that the set-up surface S1 (first surface) faces the support body 16. A surface S2 (hereinafter called "ejection surface"), which is located on the opposite side to the set-up surface S1 in each of the liquid ejecting heads D, faces the medium 12 in a state of being parallel to the X-Y plane. In the ejection surface S2 (second surface) of each of the liquid ejecting heads D, a plurality of nozzles N are formed. A desired image is formed on the surface of the medium 12 by each of the liquid ejecting heads D ejecting ink onto the medium 12 from the nozzles N while the medium 12 is being transported by the transport mechanism 24. The direction that is perpendicular to the X-Y plane which is parallel to the surface of the medium 12 is hereinafter referred to as the Z direction. As can be understood from FIG. 2, the set-up surface S1 of each of the liquid ejecting heads D is a surface that faces in the negative Z direction (the upward vertical direction), and the ejection surface S2 of each of the liquid ejecting heads D is a surface that faces in the positive Z direction (the downward vertical direction). The direction of ejection of ink by the liquid ejecting heads D corresponds to the positive Z direction.

Figure 3:
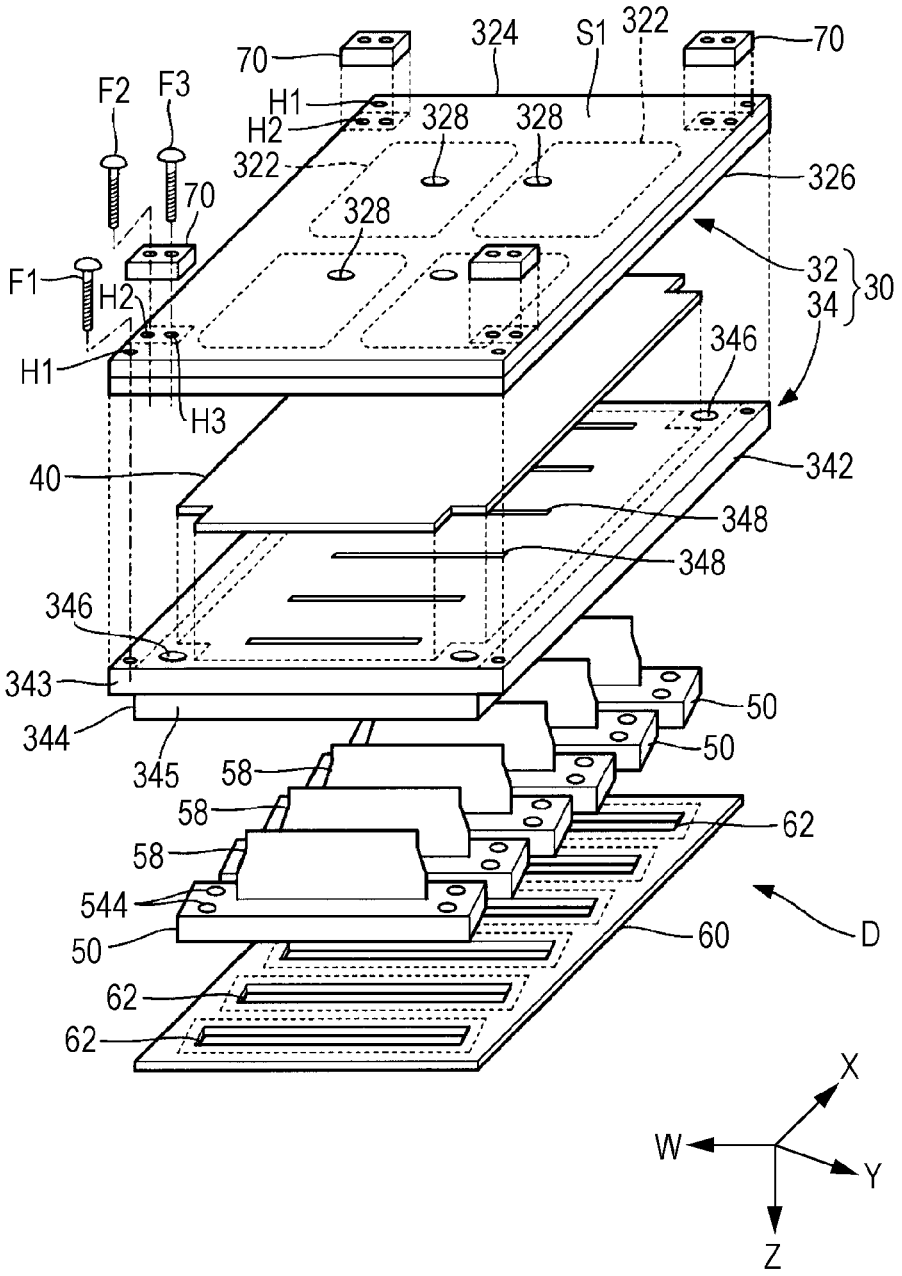
FIG. 3 is an exploded perspective view of a liquid ejecting head.
Figure 4:
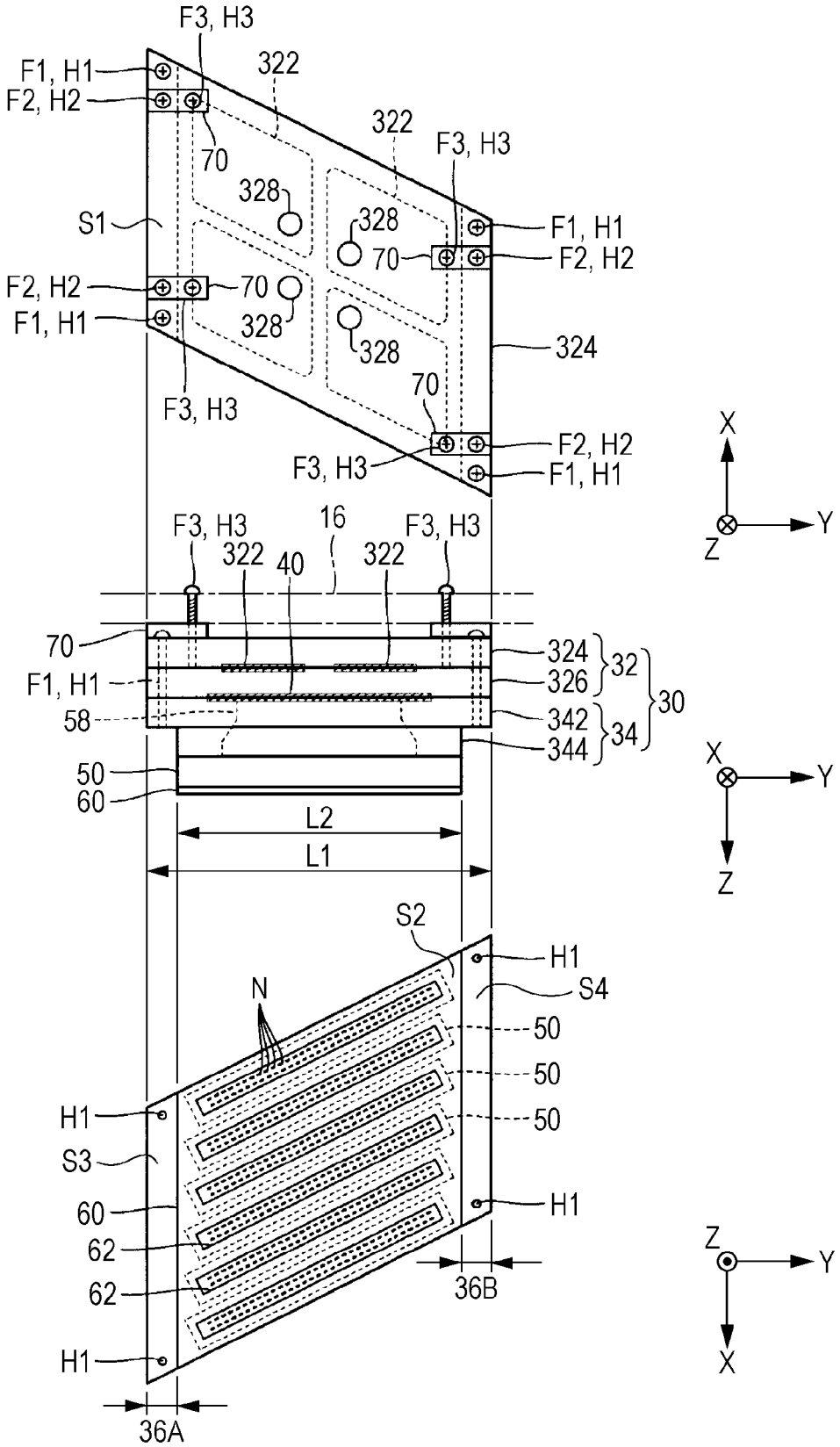
FIG. 4 is a schematic diagram of a liquid ejecting head.

FIG. 3 is an exploded perspective view of an arbitrary one of the liquid ejecting heads D. FIG. 4 is a schematic diagram illustrating the positional relationship between components forming a liquid ejecting head D. As illustrated in FIG. 3 and FIG. 4, the liquid ejecting heads D of this embodiment each include a flow path structure 30, a circuit substrate 40, a plurality (in the example in FIG. 3 there are 6) of liquid ejection units 50, and a fixing plate 60. The plurality of liquid ejection units 50 are arranged between the flow path structure 30 and the fixing plate 60. The circuit substrate 40 is a wiring substrate on which an IC chip (not illustrated) is mounted, the IC chip supplying each of the liquid ejection units 50 with a driving signal, power supply voltage, or the like.

Each of the liquid ejection units 50 is a head chip that ejects ink from the plurality of nozzles N. As illustrated in FIG. 2, the plurality of nozzles N of each of the liquid ejection units 50 are arranged in two rows along the W direction which is inclined at a given angle with respect to the X direction and the Y direction (for example, an angle within a range of 30 degrees or more and 60 degrees or less). The inks of four colors stored in the liquid container 14 are supplied in parallel to the plurality of liquid ejection units 50. The plurality of nozzles N of each of the liquid ejection units 50 are grouped into sets of four, every set ejecting a different ink. As above, because the plurality of nozzles N are arranged in the W direction which is inclined with respect to the Y direction in which the medium 12 is transported, compared with a structure in which the plurality of nozzles N are arranged along the X direction, it is possible to increase the substantial resolution (dot density) in the X direction of the medium 12.

Figure 5:
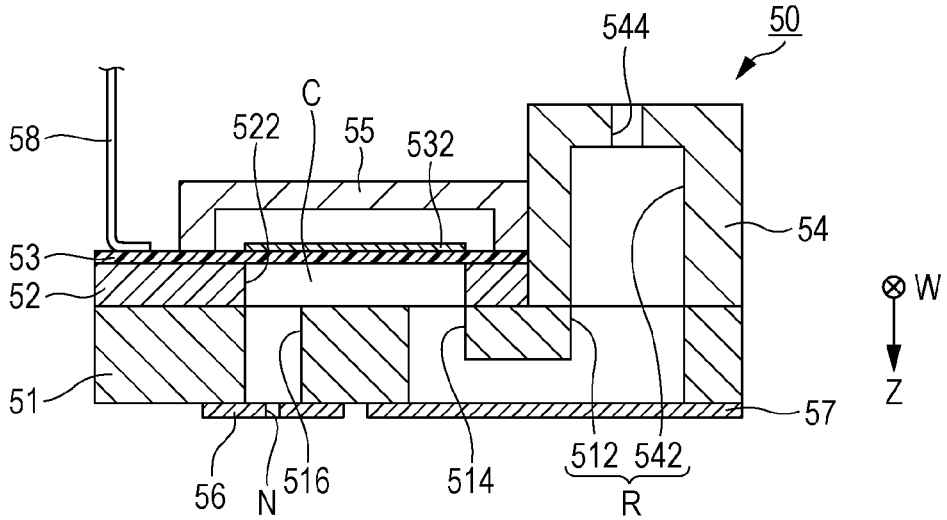
FIG. 5 is a cross-sectional view of a liquid ejecting unit.

FIG. 5 is a cross-sectional diagram (cross section that is perpendicular to the W direction) of a portion corresponding to an arbitrary one of the nozzles N in a corresponding one of the liquid ejection units 50. As illustrated in FIG. 5, the liquid ejection unit 50 of this embodiment is a structure in which a pressure chamber substrate 52, a diaphragm 53, a housing 54, and a sealing body 55 are arranged on one side of a flow path substrate 51 (specifically on the negative Z direction side), and a nozzle plate 56 and a compliance unit 57 are arranged on the other side of the flow path substrate 51. The components of the liquid ejection unit 50 are each schematically a substantially tabular member that is long in the W direction and are, for example, fixed to each other with an adhesive agent. The plurality of nozzles N are formed in the nozzle plate 56.

The flow path substrate 51 is a flat plate in which ink flow paths are formed. In the flow path substrate 51 of this embodiment, an opening 512, a supply flow path 514 and a communication flow path 516 are formed. The supply flow path 514 and the communication flow path 516 are through holes formed in every nozzle N, and the opening 512 is a through hole that is continuous throughout the plurality of nozzles N. A space formed of a reception unit (concavity) 542 formed in the housing 54 and the opening 512 of the flow path substrate 51, which communicate with each other, functions as a liquid storage chamber (receiver) R that stores ink supplied from the liquid container 14 along an introduction flow path 544 of the housing 54. The compliance unit 57 of FIG. 5 forms the bottom of the liquid storage chamber R and reduces pressure fluctuation of ink in the liquid storage chamber R.

In the pressure chamber substrate 52 of FIG. 5, an opening 522 is formed in every nozzle N. The diaphragm 53 is a flat plate that can elastically vibrate, and is fixed on a surface of the pressure chamber substrate 52 on the opposite side to the flow path substrate 51. The space that is interposed between the diaphragm 53 and the flow path substrate 51 on the inside of each of the openings 522 of the pressure chamber substrate 52 functions as a pressure chamber (cavity) C to be filled with ink supplied from the liquid storage chamber R along the supply flow path 514. The pressure chamber C communicates with the corresponding nozzle N along the communication flow path 516 of the flow path substrate 51. In every nozzle N, a piezoelectric element 532 is formed on the surface of the diaphragm 53 that is on the opposite side to the pressure chamber substrate 52. The piezoelectric element 532 is a drive element in which a piezoelectric substance is interposed between opposing electrodes. The plurality of piezoelectric elements 532 are sealed by the sealing body 55.

As illustrated in FIG. 5, a wiring substrate 58 is fixed to the liquid ejection unit 50. The wiring substrate 58 is a flexible wiring substrate (Chip On Film (COF)) on which wiring is formed for electrically connecting the liquid ejection unit 50 to the circuit substrate 40. Specifically, a positive-Z-direction-side end portion of the wiring substrate 58 is fixed to the diaphragm 53 of the liquid ejection unit 50, and a negative-Z-direction-side end portion is fixed to the circuit substrate 40 of FIG. 3. By making each of the piezoelectric elements 532 vibrate by application of a driving signal supplied along a corresponding one of the wiring substrates 58 from the circuit substrate 40 to a corresponding one of the liquid ejection units 50, the pressure inside the pressure chamber C changes and ink inside the pressure chamber C is ejected from the corresponding nozzle N.

As illustrated in FIG. 3 and FIG. 4, the fixing plate 60 is a flat plate parallel to the X-Y plane, is formed of a material with high rigidity such as stainless steel, and is fixed to the flow path structure 30 by a fixing portion such as an adhesive agent or screws. The plurality of liquid ejection units 50 are fixed to the negative-Z-direction-side surface of the fixing plate 60 with, for example, an adhesive agent. An opening 62, through which the plurality of nozzles N of each of the liquid ejection units 50 are exposed, is formed in the fixing plate 60. The positive-Z-direction-side surface of the fixing plate 60 corresponds to the ejection surface S2 of FIG. 2. The plurality of nozzles N are distributed in the plane of the ejection surface S2 (X-Y plane). As illustrated in FIG. 2 and FIG. 4, the shape of the ejection surface S2 in plan view is a parallelogram formed of a pair of edges extending in the W direction and a pair of edges extending in the X direction.

The flow path structure 30 of FIG. 3 is a structure for supplying the inks of four colors stored in the liquid container 14 to each of the plurality of liquid ejection units 50 and includes a liquid processing section 32 and a liquid distribution section 34. The liquid processing section 32 removes bubbles, contaminants and the like from each ink supplied from the liquid container 14. As illustrated in FIG. 3, the liquid processing section 32 of this embodiment includes four filters 322 that correspond to the four colors of the inks supplied from the liquid container 14, and a first holding member 324 and a second holding member 326 that are tabular members and hold each of the filters 322. The first holding member 324 is stacked on the negative Z direction side of the second holding member 326, and the four filters 322 are installed between the first holding member 324 and the second holding member 326. Four supply openings 328 that correspond to the four different inks are formed in the negative-Z-direction-side surface of the first holding member 324 and four outflow openings (not illustrated) that correspond to the different inks are formed in the positive-Z-direction-side surface of the second holding member 326. The ink supplied to each of the supply openings 328 of the first holding member 324 from the liquid container 14 passes through the filters 322 and is discharged from each of the outflow openings of the second holding member 326. The negative-Z-direction-side surface of the first holding member 324 corresponds to the set-up surface S1 fixed to the support body 16 of the liquid ejecting module 26.

The liquid distribution section 34 distributes each of the inks of four colors that have passed through the liquid processing section 32 into six groups (a total of 24 groups) that correspond to the different liquid ejection units 50. As illustrated in FIG. 3 and FIG. 4, the liquid distribution section 34 of this embodiment is a structure in which a first flow path member 342 and a second flow path member 344 are stacked. Grooves are formed in the surfaces of the first flow path member 342 and the second flow path member 344 that oppose each other, and thus flow paths for each of the inks are formed by fixing the first flow path member 342 and the second flow path member 344 to each other with, for example, an adhesive agent. Four supply openings 346 are formed in the surface of the first flow path member 342 that is on the opposite side to the second flow path member 344, and inks discharged from each of the outflow openings of the liquid processing section 32 are supplied in parallel to each of the supply openings 346. Then, the inks distributed in six groups by the flow paths inside the liquid distribution section 34 are supplied to the introduction flow paths 544 of each of the liquid ejection units 50 from four outflow openings (not illustrated) formed in each of the liquid ejection units 50 in the surface of the second flow path member 344 on the opposite side to the first flow path member 342.

As illustrated in FIG. 4, the dimension L1 of the first flow path member 342 in the Y direction is larger than the dimension L2 of the second flow path member 344 in the Y direction (L1>L2). Therefore, a portion 36A near the periphery of the first flow path member 342 on the negative Y direction side, in plan view, protrudes from the periphery of the second flow path member 344 in the negative Y direction, and a portion 36B near the periphery of the first flow path member 342 on the positive Y direction side, in plan view, protrudes from the periphery of the second flow path member 344 in the positive Y direction. The surface S3 of the portion 36A and the surface S4 of the portion 36B of the first flow path member 342 are level surfaces that face in the positive Z direction (hereafter called "support surfaces"). The support surface S3 is a region of the first flow path member 342 that extends from the periphery of the second flow path member 344 in the negative Y direction, and the support surface S4 is a region of the first flow path member 342 that extends from the periphery of the second flow path member 344 in the positive Y direction. That is, the first flow path member 342 has the support surface S3 (third surface) and the support surface S4 (fourth surface). As can be understood from the above explanation, by fixing the first flow path member 342 and the second flow path member 344 to each other, an ink flow path is formed therebetween and the support surface S3 and the support surface S4 are formed.

As illustrated in FIG. 3 and FIG. 4, the first holding member 324 and the second holding member 326 of the liquid processing section 32 are formed so as to have substantially the same external shape as the first flow path member 342 in plan view. That is, the length of each of the first holding member 324 and the second holding member 326 in the Y direction is the same as that of the first flow path member 342 (length L1). Therefore, each of the first holding member 324 and the second holding member 326 includes portions that overlap, in plan view, the support surface S3 and the support surface S4 of the liquid distribution section 34 (that is, portions that project from the periphery of the second flow path member 344 in the positive and negative Y directions).

However, as can be understood from FIG. 3, the lengths of the first flow path member 342 and the second flow path member 344 in the X direction are the same. Therefore, as can be understood from FIG. 4, when viewed from the Z direction, a support surface is not formed on either of the positive X direction side or negative X direction side of the liquid distribution section 34. As can be understood from the above explanation, the support surface S3 and the support surface S4, when viewed from the Z direction, are separated from each other in the Y direction with the ejection surface S2 interposed therebetween. Because the plurality of liquid ejection units 50 and the fixing plate 60 are arranged on the positive Z direction side of the liquid distribution section 34, as illustrated in FIG. 2 and FIG. 4, the support surface S3 and the support surface S4 are located on the negative Z direction side of the ejection surface S2. In other words, it can be said that the support surface S3 and the support surface S4 are located between the set-up surface S1 and the ejection surface S2.

As described above, in this embodiment, the support surface S3 and the support surface S4 are formed so as to be separated from each other in the Y direction with the ejection surface S2 interposed therebetween in plan view and the support surfaces are not formed on the positive and negative X direction sides. Therefore, as illustrated in FIG. 2, regarding the Y direction in which the medium 12 is transported, the support surface S3 is located on the upstream side of the ejection surface S2 and the support surface S4 is located on the downstream side, and the support surfaces are not formed between the ejection surfaces S2 of liquid ejecting heads D that are adjacent to each other. That is, the support surfaces S3 of the liquid ejecting heads D are arranged in a line in the X direction and the support surfaces S4 of the liquid ejecting heads D are also arranged in a line in the X direction. Between the array of support surfaces S3 and the array of support surfaces S4, the ejection surfaces S2 of the liquid ejecting heads D are arranged in a line in the X direction. According to the above described structure, for example, compared with a structure in which the support surfaces are formed on both the X direction sides and Y direction sides of the ejection surface S2 (for example, a structure in which the support surfaces surround the whole periphery of the ejection surface S2 in plan view), it is possible to reduce the spacing between the nozzles N of adjacent liquid ejecting heads D along the X direction.

As illustrated in FIG. 3, because the support surfaces are not formed on the positive X direction side or the negative X direction side of the liquid distribution section 34, in the positive X direction side and the negative X direction side of the liquid distribution section 34, both a side surface 343 of the first flow path member 342 and a side surface 345 of the second flow path member 344 that abut each other in the Z direction are substantially in-plane in a state of being oriented in the X direction. In the above structure, for example, the ink that has entered the gap between liquid ejecting heads D abutting each other in the X direction is guided by and held between the side surface 343 of the first flow path member 342 and the side surface 345 of the second flow path member 344 by capillary force at the boundary of the side surface 343 of the first flow path member 342 and the side surface 345 of the second flow path member 344. Therefore, there is an advantage in that the likelihood of ink that has entered the gap between the liquid ejecting heads D flowing to the medium 12 and adhering to the target medium 12 is reduced.

As illustrated in FIG. 3, the circuit substrate 40 is arranged between the liquid processing section 32 and the liquid distribution section 34. Therefore, the liquid distribution section 34 is located between the circuit substrate 40 and the plurality of liquid ejection units 50. The flow paths of the four groups that enable the liquid processing section 32 and the liquid distribution section 34 to communicate with each other (for example, the supply openings 346 of the liquid distribution section 34) are located on the four corners of the liquid processing section 32, the liquid distribution section 34 or the like (the periphery of the circuit substrate 40) in plan view. Moreover, in the liquid distribution section 34, six through holes 348 corresponding to different liquid ejection units 50 are formed. Each of the through holes 348 is formed at a position that does not interfere with the flow path inside the liquid distribution section 34 and is an opening (slit) that extends in the W direction in plan view. The wiring substrate 58 of each of the liquid ejection units 50 is inserted in the through hole 348 and the end portion thereof protruding in the negative Z direction is connected to the circuit substrate 40. As above, in this embodiment, because the wiring substrate 58 of each of the liquid ejection units 50 is arranged in such a manner as to pass through the inside of the liquid distribution section 34 and reach the circuit substrate 40, there is an advantage in that, compared with, for example, when viewed from the Z direction, a structure in which the wiring substrate 58 goes around the liquid distribution section 34 and reaches the circuit substrate 40, it is easy to secure the support surface S3 and the support surface S4.

As illustrated in FIG. 3 and FIG. 4, the liquid processing section 32 and the liquid distribution section 34 are fixed to each other with a plurality of fastening components F1. Specifically, the first holding member 324 and the second holding member 326 of the liquid processing section 32, and the first flow path member 342 of the liquid distribution section 34 are fixed to each other using the fastening components F1. In FIG. 3, one of the fastening components F1 is illustrated as a typical example.

Each of the fastening components F1 of this embodiment is a screw inserted from the negative Z direction side into an insertion hole H1 that extends through the first holding member 324, the second holding member 326, and the first flow path member 342 in the Z direction. As can be understood from FIG. 3 and FIG. 4, each of the fastening components F1 is located in a region overlapping the support surface S3 or the support surface S4 in plan view. Specifically, in plan view, each of the fastening components F1 is arranged on the periphery of the circuit substrate 40 (the four corners of the first holding member 324). As can be understood from the above explanation, the first holding member 324, the second holding member 326, and the first flow path member 342 of this embodiment are fixed to each other at locations (the locations of the periphery of the circuit substrate 40) overlapping the support surface S3 and the support surface S4 in plan view. As described above, in this embodiment, because the first holding member 324 and the second holding member 326 are fixed to each other with the fastening components F1, the first holding member 324 and the second holding member 326 can be detached from each other by removing the fastening components F1. That is, the first holding member 324 and the second holding member 326 are detachably fixed to each other. Therefore, it is possible to perform maintenance such as removal and cleaning of each of the filters 322 of the liquid processing section 32 when appropriate.

The first holding member 324, the second holding member 326, the first flow path member 342, and the second flow path member 344 are formed of the same material. For example, each member is formed by injection molding of a resin material such as Xyron (registered trademark). Therefore, the mechanical characteristics including the linear expansion coefficient, are the same for each material. According to the above described structure, because the occurrence of thermal stress caused by differences in linear expansion coefficient between individual members forming the liquid ejecting heads D is prevented, there is an advantage in that deviation of the position of each member can be reduced.

As illustrated in FIG. 3 and FIG. 4, each of the liquid ejecting heads D of this embodiment is fixed to the support body 16 via a plurality of adjustment members 70 located between the set-up surface S1 and the support body 16 of the liquid ejecting module 26. Each of the adjustment members 70 is a spacer for adjusting the gap between the set-up surface S1 and the support body 16 of the liquid ejecting heads D, and is located on a corresponding one of the four corners of the set-up surface S1 (the first holding member 324) in plan view. That is, by suitably choosing the size of the adjustment member 70 in the Z direction, it is possible to adjust the gap between the set-up surface S1 and the support body 16 of each of the liquid ejecting heads D (that is, the height of each of the liquid ejecting heads D) for every liquid ejecting head D.

As illustrated in FIG. 3 and FIG. 4, each of the adjustment members 70 is fixed to the liquid ejecting heads D (the liquid processing section 32) by using fastening components F2. The fastening components F2 of this embodiment are screws that are inserted from the negative Z direction side into insertion holes H2 that extend through the adjustment members 70 and the first holding member 324 in the Z direction. Moreover, each of the adjustment members 70 is fixed to the support body 16 by using fastening components F3. The fastening components F3 of this embodiment are screws that are inserted from the negative Z direction side into insertion holes H3 that extend through the adjustment members 70 and the support body 16 in the Z direction. In FIG. 3, one of the fastening components F2 and one of the fastening components F3 are illustrated as typical examples.

As illustrated in FIG. 4, the fastening components F2 and the insertion holes H2 are located in a region that overlaps the support surface S3 or the support surface S4 in plan view. However, the fastening components F3 and the insertion holes H3 do not overlap the support surface S3 and the support surface S4 in plan view. As can be understood from the above explanation, each of the adjustment members 70, is fixed to the first holding member 324 of the liquid ejecting heads D at a position closer to the support surface S3 or the support surface S4 (at a location inside the support surface S3 or the support surface S4 in plan view) than a position at which the adjustment member 70 is fixed to the support body 16. That is, the locations at which the adjustment members 70 are fixed to the liquid ejecting heads D (the locations of the fastening portions F2 and the insertion holes H2) are closer to the support surface S3 and the support surface S4 in plan view than the locations at which the adjustment members 70 are fixed to the support body 16 (the location of the fastening members F3 and the insertion holes H3).

As described above, in this embodiment, the set-up surface S1 facing the support body 16 on the opposite side to (negative side of) the ejection surface S2 is fixed to the support body 16. That is, the liquid ejecting heads D are fixed to the support body 16 in a suspended state. Therefore, for example, compared with a structure in which the liquid ejecting heads D are fixed to the support body 16 at portions that protrude in the X direction and the Y direction, there is an advantage in that the size of the liquid ejecting heads D when viewed from the Z direction can be reduced.

Figure 6:
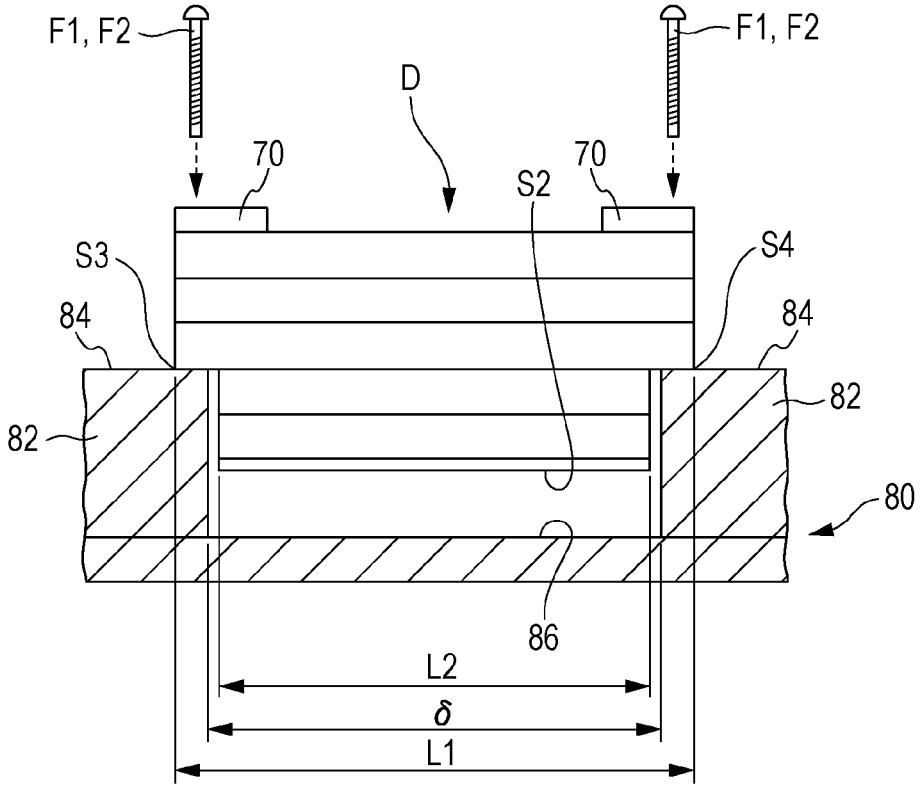
FIG. 6 is a schematic diagram of a support of a liquid ejecting head.

Moreover, in this embodiment, in the stage prior to fixing the liquid ejecting heads D to the support body 16 of the liquid ejecting module 26, it is possible to hold the liquid ejecting heads D by using the support surface S3 and the support surface S4. Specifically, a holder 80 as illustrated in FIG. 6 is used to hold the liquid ejecting heads D. The holder 80 includes a pair of supporting units 82 arranged in such a manner as to form a gap δ. The gap δ between the supporting units 82 is larger than the length L2 of the second flow path member 344 in the Y direction and smaller than the length L1 of the first flow path member 342 in the Y direction ($L2<\delta<L1$). The liquid ejecting heads D are held between the pair of supporting units 82 in a state where the upper surface (hereinafter called "mounting surface") 84 of each of the supporting units 82 is in contact with a corresponding one of the support surface S3 and the support surface S4. As illustrated in FIG. 6, in the state where the liquid ejecting heads D are held by the holder 80, the ejection surface S2 is separated from the bottom surface 86 of the holder 80. In the above state, by supplying a test driving signal to each of the piezoelectric elements 532, it is possible to check the ink ejection performance and the ink ejection amount for each of the nozzles N. Moreover, it is possible to transport liquid ejecting heads D in a state where the liquid ejecting heads D are held by the holder 80.

As can be understood from the above explanation, the portion 36A located on the negative Y direction side (support surface S3) of the first flow path member 342 of the liquid distribution section 34 and the portion 36B located on the positive Y direction side (support surface S4) of the first flow path member 342 of the liquid distribution section 34 are used as a gripper for temporarily holding each of the liquid ejecting heads D prior to actually fixing the set-up surface S1 to the support body 16. Moreover, as can be understood from the side view in FIG. 2, there is an advantage in that the gap on the positive Z direction side of the support surface S3 and the support surface S4 (the gap defined by the ejection surface S2 and the support surface S3 or the support surface S4) can be used in the installation of the transport mechanism 24. Specifically, for example, compared with a structure in which the support surface S3 and the support surface S4 are located in the same plane as the ejection surface S2, because the distance between the transport roller 242 and the discharge roller 244 is decreased, there is an advantage in that it is possible to suppress deformation of the medium 12 in the interval between the transport roller 242 and the discharge roller 244 (therefore an error, deviation or the like in the distance between the surface of the medium 12 and each of the nozzles N can be reduced).

Moreover, as illustrated in FIG. 6, the fastening components F1 and the fastening components F2 are arranged in the liquid ejecting heads D in a state where the support surface S3 and the support surface S4 are in contact with corresponding ones of the mounting surfaces 84 of the holder 80. As mentioned above, because the insertion holes H1 in which the fastening components F1 are inserted are located in a region that overlaps the support surface S3 or the support surface S4 in plan view, when external force for inserting the fastening components F1 into the insertion holes H1 from the negative Z direction side is applied to the fastening components F1, the support surface S3 and the support surface S4 equally press the mounting surfaces 84 in a state where corresponding ones of the mounting surfaces 84 of the holder 80 are in surface contact with the support surface S3 and the support surface S4. Therefore, there is an advantage in that the fastening components F1 can be installed in a state where the posture of the liquid ejecting heads D is stably maintained without the ejection surface S2 coming into contact with the bottom surface 86. Likewise, because the insertion holes H2 in which the fastening components F2 are inserted are located in a region that overlaps the support surface S3 or the support surface S4 in plan view, there is an advantage in that the fastening components F2 and the adjustment members 70 can be installed in a state where the posture of the liquid ejecting heads D is stably maintained.

In this embodiment, the first holding member 324 and the second holding member 326 of the liquid processing section 32 and the first flow path member 342 of the liquid distribution section 34 are fixed to the periphery of the circuit substrate 40 when viewed from the Z direction. Therefore, for example, compared with a structure in which the fastening components F1 also pass through the circuit substrate 40, it is possible to decrease the stress generated in the circuit substrate 40 as a result of pressing the fastening components F1 when the fastening components F1 are inserted into the insertion holes H1 to fix the members to each other. Therefore, there is an advantage in that it is possible to prevent or suppress deformation of the circuit substrate 40, disconnection of wiring or the like.

Moreover, each of the filters 322 is held by the first holding member 324 and the second holding member 326 located on the negative Z direction side of the first flow path member 342 having the support surface S3 and support surface S4. That is, the first holding member 324 and the second holding member 326, which are longer in the Y direction than the member (the second flow path member 344) located on the positive Z direction side of the first flow path member 342, are used to hold the filters 322. Therefore, compared with a structure in which the filters 322 are held between the ejection surface S2 and the support surface S3 or the support surface S4 (a structure in which the members that hold the filters 322 are restricted to the length L2), it is possible to increase the size of each of the filters 322. Likewise, in this embodiment, because the circuit substrate 40 is arranged between the members on the negative Z direction side of the first flow path member 342, it is possible to increase the size of the circuit substrate 40 compared with a structure in which the circuit substrate 40 is arranged between the ejection surface S2 and the support surface S3 or the support surface S4.

Modifications

The above described embodiment can be modified in various ways. Specific examples of the modifications will be described below. Two or more examples arbitrarily chosen from the following examples can be combined appropriately as long as they do not contradict each other.

(1) In the above described embodiment, the first holding member 324 and the second holding member 326 of the liquid processing section 32 and the first flow path member 342 of the liquid distribution section 34 are fixed to each other with the fastening components F1, however, the manner in which the individual members forming the flow path structure 30 are fixed to each other is not limited to the above example. For example, it is possible to fix the individual members forming the flow path structure 30 by crimping (typically thermal crimping). In a structure that uses crimping for fixing individual members, as with the location of the fastening components F1 of the above described embodiment, it is preferable to have a structure in which individual members are fixed by crimping in a region that overlaps the support surface S3 or the support surface S4 in plan view. As can be understood from the above explanation, at least two members among the plurality of members including the member having the support surface S3 and the support surface S4 (for example the first flow path member 342) and members stacked on the member having the support surface S3 and the support surface S4 (for example first holding member 324 and the second holding member 326), are fixed to each other at a location that overlaps the support surface S3 or the support surface S4 when viewed from the Z direction and are typically located in a region where connecting portions (portions that fix individual members to each other) such as the fastening components F1, the crimped portion, or the like overlap the support surface S3 or the support surface S4.

(2) The structure for fixing each of the liquid ejecting heads D to the support body 16 is not limited to the above described example. For example, it is possible to directly fix the set-up surface S1 of the liquid ejecting heads D to the support body 16 using, for example, an adhesive agent or the fastening components F3 and without placing the adjustment members 70 therebetween. That is, the set-up surface S1 of the liquid ejecting heads D is comprehensively defined as a surface which faces the support body 16 on the negative Z direction side and is fixed to the support body 16, irrespective of how the set-up surface S1 and the support body 16 are fixed to each other or whether the set-up surface S1 and the support body 16 are in contact.

(3) In the above described embodiment, a structure in which the location where the adjustment members 70 are fixed to the liquid ejecting heads D (the location of the fastening components F2 and the insertion holes H2) is located on the inner side of the support surface S3 or the support surface S4 in plan view and in which the location where the adjustment members 70 are fixed to the support body 16 (the location of the fastening components F3 and the insertion holes H3) is located on the outer side of the support surface S3 or the support surface S4 in plan view is given as an example, however, the relationships of the fixing location of the liquid ejecting heads D and the fixing location of the support body 16 with respect to the adjustment members 70 are not limited to the above example. For example, a structure in which the fixing location of the adjustment members 70 and the liquid ejecting heads D and the fixing location of the adjustment members 70 and the support body 16 are both located on the inner side (or outer side) of the support surface S3 or the support surface S4 in plan view can also be adopted. However, from the viewpoint of the adjustment members 70 being fixed to the set-up surface S1 in a state where the posture of the liquid ejecting heads D is stably maintained, it is preferable to have a structure in which the fixing position of the adjustment members 70 and the liquid ejecting heads D is closer to the support surface S3 or the support surface S4 in plan view than the the arrangement position of the adjustment members 70 and the support body 16 is.

(4) Elements that cause ink to be ejected from each of the nozzles N are not limited to the piezoelectric elements 532 described above. For example, it is also possible to use, instead of the piezoelectric element 532, a heat generation element that changes the pressure in the pressure chamber C by generating bubbles as a result of heating and ejects ink from the nozzles N. The piezoelectric element 532, the heat generation element or the like are included as a drive element (pressure generation element) that changes the pressure in the pressure chamber C, and any method of inducing a change in pressure in the pressure chamber C (piezo method/thermal method) and any specific structure can be employed in this invention.

(5) The printing apparatus 10 described in the above embodiment may be adopted in a printing-only device or any one of various devices such as a facsimile device, a photocopier or the like. However, the use of the liquid ejecting apparatus of this invention is not limited to printing. For example, a liquid ejecting apparatus that ejects a solution of color materials can be used as a manufacturing device for forming the color filters of liquid crystal displays. Moreover, a liquid ejecting apparatus that ejects a solution of conductive materials can be used as a manufacturing device for forming wiring or electrodes of a wiring substrate or the like.

What is claimed is:

1. A liquid ejecting head comprising:

a first surface that faces a support body on a first side of a first direction and is fixed to the support body, a second surface that faces a second side opposite the first side in the first direction, and in which are located nozzles configured to eject liquid, a third surface and a fourth surface that face the second side in the first direction and are located on the first side of the first direction with respect to the second surface, and when viewed in the first direction, are separated from each other with the second surface interposed therebetween in a second direction that is perpendicular to the first direction.

2. The liquid ejecting head according to claim 1, further comprising a plurality of members including a member having the third surface and the fourth surface and another member stacked on the first side of the first direction with respect to the member having the third surface and the fourth surface, wherein at least two members among the plurality of members, when viewed from the first direction, are fixed to each other at a position that overlaps the third surface or the fourth surface.

3. The liquid ejecting head according to claim 2, further comprising a circuit substrate arranged between the plurality of members, wherein the plurality of members, when viewed from the first direction, are fixed at the periphery of the circuit substrate.

4. The liquid ejecting head according to claim 3, further comprising a plurality of drive elements that cause the liquid to be ejected from the nozzles, wherein the plurality of drive elements are electrically connected to the circuit substrate via wiring that passes through a through hole formed in at least one member among the plurality of members.

5. A liquid ejecting apparatus comprising:

a support body;

a plurality of liquid ejecting heads each of which is the liquid ejecting head according to claim 4, wherein the liquid ejecting heads are fixed to the support body and arranged in a third direction that is perpendicular to the first direction and the second direction.

6. A liquid ejecting apparatus comprising:

a support body;

a plurality of liquid ejecting heads each of which is the liquid ejecting head according to claim 3, wherein the liquid ejecting heads are fixed to the support body and arranged in a third direction that is perpendicular to the first direction and the second direction.

7. The liquid ejecting head according to claim 2, wherein the plurality of members include a holding member that holds a filter through which the liquid passes, and the plurality of members are fixed to each other in a detachable state.

8. A liquid ejecting apparatus comprising:

a support body;

a plurality of liquid ejecting heads each of which is the liquid ejecting head according to claim 7, wherein the liquid ejecting heads are fixed to the support body and arranged in a third direction that is perpendicular to the first direction and the second direction.

9. A liquid ejecting apparatus comprising:

a support body;

a plurality of liquid ejecting heads each of which is the liquid ejecting head according to claim 2, wherein the liquid ejecting heads are fixed to the support body and arranged in a third direction that is perpendicular to the first direction and the second direction.

10. The liquid ejecting head according to claim 1, further comprising:

a first flow path member that has the third surface and the fourth surface, and a second flow path member that is fixed to the first flow path member and that forms a flow path for the liquid between the second flow path member and the first flow path member.

11. The liquid ejecting head according to claim 10, wherein the first flow path member and the second flow path member include a side surface that faces in a third direction that is perpendicular to the first direction and the second direction.

12. A liquid ejecting apparatus comprising:

a support body;

a plurality of liquid ejecting heads each of which is the liquid ejecting head according to claim 11, wherein the liquid ejecting heads are fixed to the support body and arranged in a third direction that is perpendicular to the first direction and the second direction.

13. A liquid ejecting apparatus comprising:

a support body;

a plurality of liquid ejecting heads each of which is the liquid ejecting head according to claim 10, wherein the liquid ejecting heads are fixed to the support body and arranged in a third direction that is perpendicular to the first direction and the second direction.

14. The liquid ejecting head according to claim 1, further comprising an adjustment member that is located between the first surface and the support body, wherein a fixing position of the adjustment member and the first surface, when viewed from the first direction, is closer to the third surface or the fourth surface than a fixing position of the adjustment member and the support body is.

15. A liquid ejecting apparatus comprising:

a support body;

a plurality of liquid ejecting heads each of which is the liquid ejecting head according to claim 14, wherein the liquid ejecting heads are fixed to the support body and arranged in a third direction that is perpendicular to the first direction and the second direction.

16. The liquid ejecting head according to claim 1, wherein a member having the first surface, a member having the third surface and a member having the fourth surface are formed of the same material.

17. A liquid ejecting apparatus comprising:

a support body;

a plurality of liquid ejecting heads each of which is the liquid ejecting head according to claim 16, wherein the liquid ejecting heads are fixed to the support body and arranged in a third direction that is perpendicular to the first direction and the second direction.

18. A liquid ejecting apparatus comprising:

a support body;

a plurality of liquid ejecting heads each of which is the liquid ejecting head according to claim 1, wherein the liquid ejecting heads are fixed to the support body and arranged in a third direction that is perpendicular to the first direction and the second direction.

* * * * *